US006640735B2

(12) United States Patent
Kwang

(10) Patent No.: US 6,640,735 B2
(45) Date of Patent: Nov. 4, 2003

(54) EMBROIDERING METHOD

(75) Inventor: Pang Kim Kwang, Singapore (SG)

(73) Assignee: Madeira Garnfabrik Rudolf Schmidt KG, Freiburg (DE)

( * ) Notice: Subject to any disclaimer, the term of this patent is extended or adjusted under 35 U.S.C. 154(b) by 0 days.

(21) Appl. No.: 10/145,300

(22) Filed: May 14, 2002

(65) Prior Publication Data

US 2002/0170478 A1 Nov. 21, 2002

(30) Foreign Application Priority Data

May 15, 2001 (DE) ..... 101 23 540

(51) Int. Cl.[7] ..... D05C 17/00
(52) U.S. Cl. ..... 112/475.18; 112/103
(58) Field of Search ..... 112/475.18, 475.19, 112/475.21, 99, 102, 102.5, 103, 1, 470.06, 470.09

(56) References Cited

U.S. PATENT DOCUMENTS 5,758,588 A * 6/1998 Orfali ..... 112/1

FOREIGN PATENT DOCUMENTS

| | | |
|---|---|---|
| DE | 44 11 364 C2 | 10/1994 |
| DE | 196 32 092 C2 | 2/1998 |
| WO | WO98/59101 | 12/1998 |

* cited by examiner

*Primary Examiner*—Peter Nerbun
(74) *Attorney, Agent, or Firm*—Henry M. Feiereisen

(57) ABSTRACT

In a time-saving machine embroidering method, an auxiliary frame, having clamped therein an auxiliary backing material, is placed in the frame of an embroidering machine. A motif is then embroidered onto the auxiliary backing material, and the auxiliary frame together with the auxiliary backing material is removed from the frame. The material to be embroidered is fixed in the frame, and subsequently the auxiliary frame with the embroidered auxiliary backing material positioned above the material to be embroidered is again fixed in the frame. Subsequently, the motif embroidered already is only fixed on the material by means of embroidering or sewing stitches. Finally, the auxiliary frame and the material provided with the motif are removed from the frame and the auxiliary backing material is removed.

10 Claims, 6 Drawing Sheets

EMBROIDERING METHOD

CROSS-REFERENCES TO RELATED APPLICATIONS

This application claims the priority of German Patent Application Serial No. 101 23 540.2-26, filed May 15, 2001, pursuant to 35 U.S.C. 119(a)–(d), the subject matter of which is incorporated herein by reference.

BACKGROUND OF THE INVENTION

The present invention relates to a method for embroidering a material, in particular textile material, with a motif by means of an embroidering machine. In general, the material to be embroidered is a garment or an accessory. However, the material need not necessarily be a textile fabric, but may also be leather or plastics.

In conventional machine embroidering methods, the material to be embroidered is clamped in the proper position into the frame below the embroidering head of an embroidering machine, in the case of multi-head machines into the frame associated to each embroidering head, and the motif is embroidered into the material according to a previously prepared embroidering program.

Instead of clamping the material, e.g., a garment, to be embroidered into the frame, a backing material can be clamped into the latter, on which backing material the material to be embroidered is fixed provisionally, for instance by means of adhesive tapes. The backing material connected with the material to be embroidered via the embroidering stitches can subsequently be cut off, as far as it is loose. When using a lining fabric or a similar fabric of little tear strength, for which the term "Easy Tear Interlining" is known, as backing material, this backing material can also completely be removed from the reverse side or back of the embroidered material by tearing it off.

Regardless of which option is used to carry out the known method, an image of the embroidery motif on the frontside or face of the material, e.g., a garment, is also produced on the backside or back of the material, i.e. on the side facing the skin of a person wearing such garment. In particular, when the motif has many stitches, a board-like hardening of the material is felt by the wearer. In the event of bulky embroidery yarns, and here in particular in the case of so-called metal embroidery yarns, this results in an impaired wear comfort or even skin irritations. It has partly been attempted to prevent this by sewing and/or adhering a piece of fabric onto the backside of the material. However, the seams are visible on the frontside, and the use of adhesive leads to a further hardening of the material in the vicinity of the embroidery. In addition, such covering of the backside of the embroidery is extremely labor-intensive for the manufacturer.

For the same reasons, the conventional machine embroidering method is also not suited for motifs protruding from the plane of the material in a relief-like manner, as, on the one hand, the material swallows a large part of the stitches, depending on the quality and strength of the material, and, on the other hand, the material becomes even stiffer and more board-like in the vicinity of the motif due to the particularly high number of stitches in the case of relief embroidery. But since motifs made in relief embroidery are very attractive, one approach, described in German Pat. No. DE 196 32 092 C2, proposed to produce the motif as so-called air embroidery, which then usually is manually fixed on the material or garment with the necessary minimum number of tacking stitches. In this way, the above-mentioned disadvantages are eliminated, but the detour via air embroidery is very time-consuming and material-intensive and therefore has to be ruled out in many cases merely for cost reasons.

Instead of manually fixing motifs produced as air embroidery on the material or garment by means of tacking stitches, it is known from German Pat. No. DE 44 11 364 C2 to control an embroidering machine with previously generated data records via the contour of the motif or motifs.

From International application WO 98/59101 it is known to embroider motifs in flat embroidery or relief embroidery onto an auxiliary backing material.

It would be desirable and advantageous to provide an improved method for embroidering a material, in particular textile material, with a motif by means of an embroidering machine, which method is time-saving and thus cost-saving and can be used in particular for commercial mass production, without the material exhibiting the prior art shortcomings in the vicinity of the embroidered motif.

SUMMARY OF THE INVENTION

According to one aspect of the present invention, a method includes the following steps:

a) An auxiliary backing material is clamped into an auxiliary frame;

b) the auxiliary frame is fixed inside the frame of an embroidering machine;

c) the motif is embroidered onto the auxiliary backing material by means of the machine;

d) the auxiliary frame with the auxiliary backing material clamped into the same and embroidered is removed from the frame;

e) the base material to be provided with the embroidered motif is fixed inside the frame;

f) the auxiliary frame with the clamped embroidered auxiliary backing material is again fixed in the frame so as to be positioned above the base material;

g) the motif is tacked onto the base material by means of embroidering or sewing stitches of the embroidering machine;

h) the auxiliary frame is removed;

i) the base material is removed from the frame;

j) the auxiliary backing material is removed.

Steps h) to j) need not be performed in the indicated order, but may also be performed in some other order.

As a result of this method, the embroidered motif is permanently attached to the intended point of the material, e.g. of the garment, with comparatively few tacking stitches only. Due to this reduction of the number of stitches on the reverse side or back of the material, the wear comfort thereof is improved decisively. In addition, a yarn not irritating the skin can be used for the embroidering or sewing stitches. Even a very stitch-intensive motif does not lead to a stiffening of the material in the embroidered region. For the motif itself, bulky or scratchy yarns including metal yarns can easily be used, because like in a so-called air embroidery the material is not pierced by the embroidery yarns forming the motif. In addition, relief-like motifs with their particularly high number of stitches get a particularly plastic three-dimensional appearance, even if the material is a comparatively soft and thick fabric, because the stitches cannot be swallowed by the fabric. There can also be achieved an impression coming very close to what is called cord yarn embroidery, without special embroidering machines or special accessory and expensive cord embroidery yarns having to be used for this purpose.

The embroidering method according to the present invention can be performed on multi-head embroidering machines. Considerable cost advantages by saving man-hours and reduced machine downtimes are chiefly obtained, however, when particularly complex motifs, which have so far been produced by what is called the air embroidery method, are applied onto garments by means of single-head machines. An important feature is the use of the auxiliary frame, which ensures that upon inserting the material to be embroidered in step e), the motif embroidered onto the auxiliary backing material in step c) again lies below the corresponding embroidering head in step f) in exactly the same position in which the motif was embroidered, so that it is ensured that the preprogrammed embroidering or sewing stitches by means of which the motif is tacked onto the material in step e) are placed at the predetermined points, e.g. along the edge of the motif.

In step e), the base material to be embroidered can be fixed inside the frame in any way. Preferably, a backing material may be clamped into the frame before the auxiliary frame is fixed inside the frame of an embroidering machine. The base material to be embroidered can then provisionally, for instance by means of adhesive tapes, be fixed on the backing material.

If the backing material should not remain below the material on the reverse side or back thereof, which is provided with the motif, or if it should not be cut away around the embroidered region, it is recommended to use a fabric as backing material which tears more easily than the yarn for the stitches used for tacking purposes. There may be used in particular so-called Easy Tear Interlinings. The backing material then is simply torn off upon completion of the article.

The backing material need not be torn off when at the place of the motif to be embroidered the backing material is provided with a cutout at least corresponding to the size of said motif.

Currently preferred as the auxiliary backing material is a material which may have several layers and can be removed by physical means. Examples of materials of this type are known to the skilled artisan, and may include a hot-melting film or water-soluble film. Alternatively, water-soluble paper such as rice paper or also cardboard can be used as auxiliary backing material.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
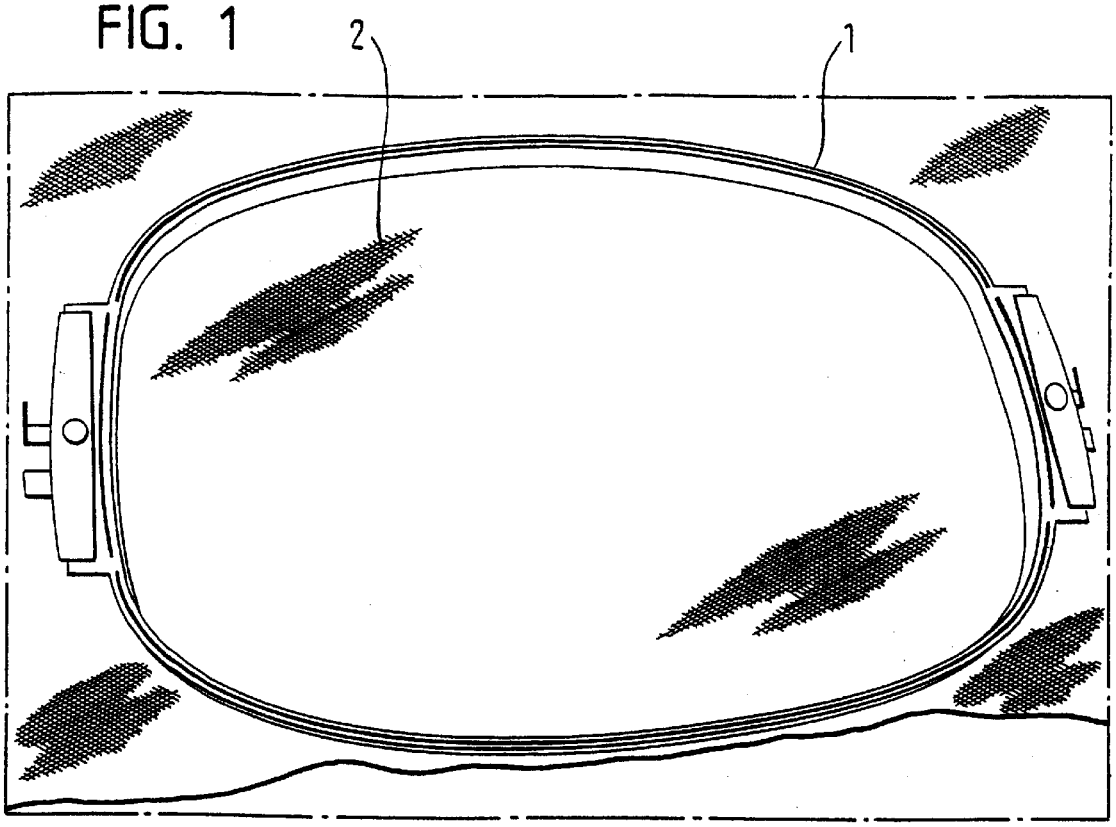
FIG. 1 is a schematic illustration of a frame of an embroidering machine for carrying out the steps of the embroidering method according to the present invention.

Throughout all the Figures, same or corresponding elements are generally indicated by same reference numerals.

Figure 2:
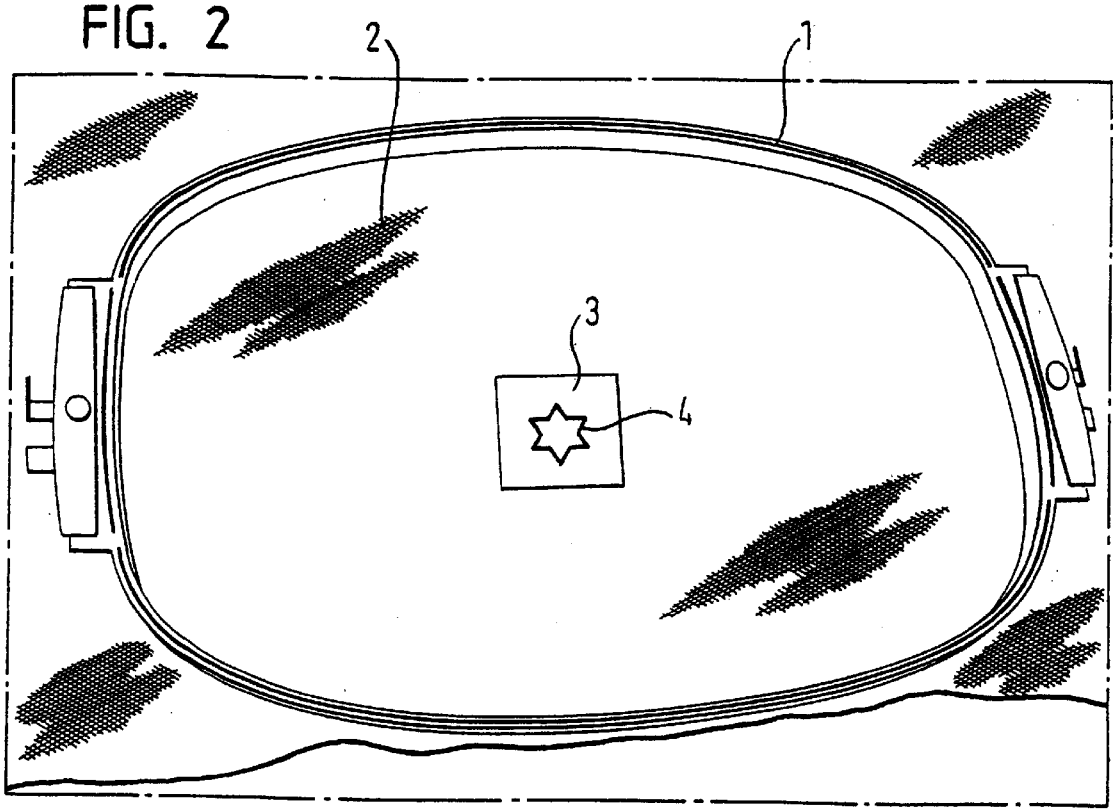
FIG. 2 is a schematic illustration of the frame, with a pattern model placed on a backing material clamped in the frame.
Figure 3:
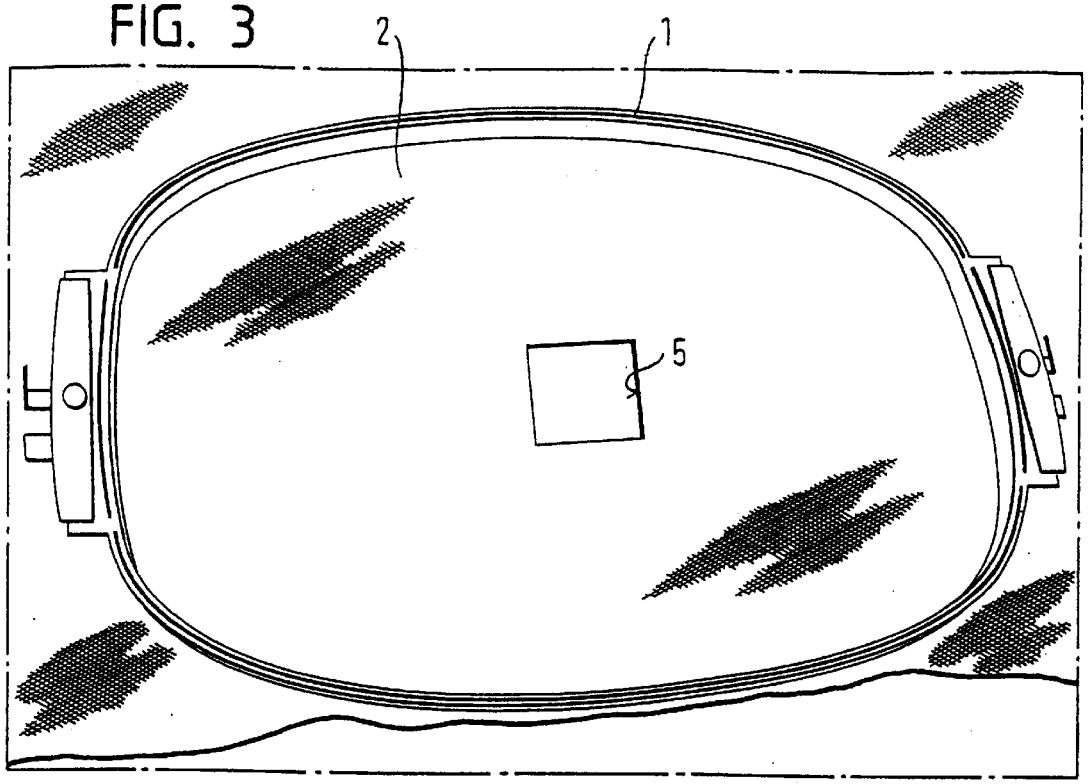
FIG. 3 is a schematic illustration of the frame, with a cutout provided in the backing material at the place of the pattern model.

Turning now to the drawing, and in particular to FIG. 1, there is shown a schematic illustration of a frame 1 of an embroidering machine for carrying out the steps of the embroidering method according to the present invention. Structure and operation of embroidering machines are generally known to the artisan and not described in more detail for sake of simplicity. Clamped in the frame 1 is a backing material 2. In a next step, as shown in FIG. 2, a pattern model 3 with a motif 4 to be embroidered, for instance a star, is applied upon the backing material 2 and fixed provisionally upon alignment below an embroidering head 6 (FIG. 4) of the embroidering machine. Subsequently, the pattern model 3 is removed and a cutout 5 is provided at the place of the pattern model 3. In the nonlimiting example shown in FIG. 3, the cutout has, for example, the configuration of a square.

Figure 4:
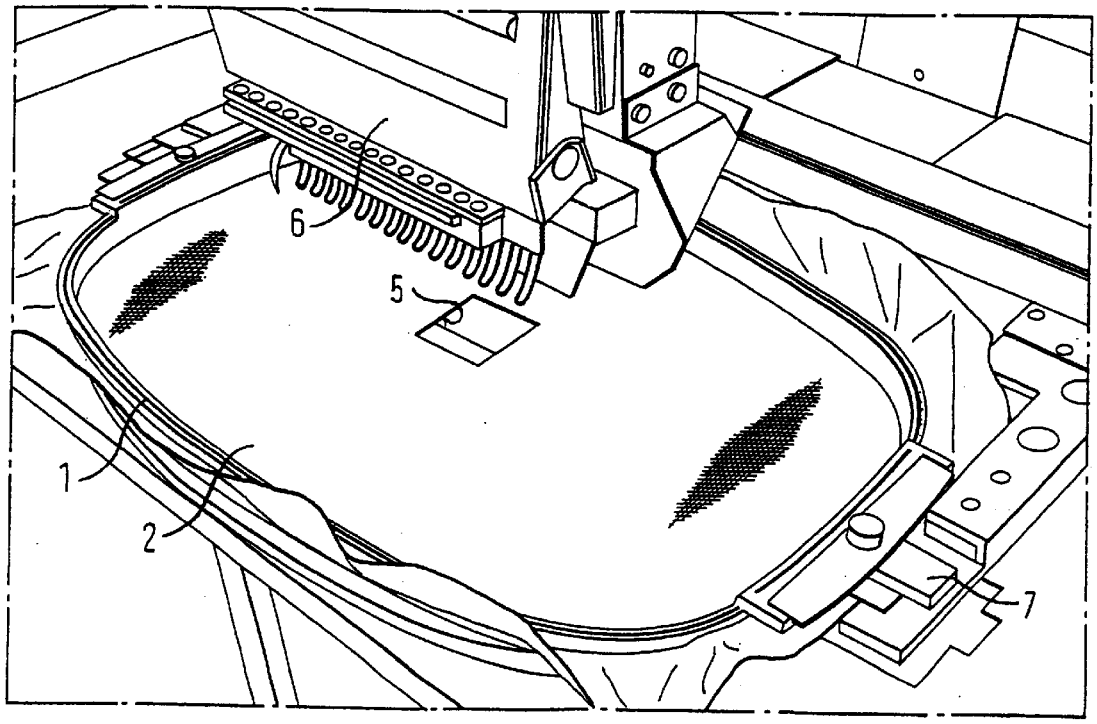
FIG. 4 is a perspective illustration of the embroidering machine, with the frame with the backing material and the cutout disposed below the embroidering head of the embroidering machine.
Figure 5:
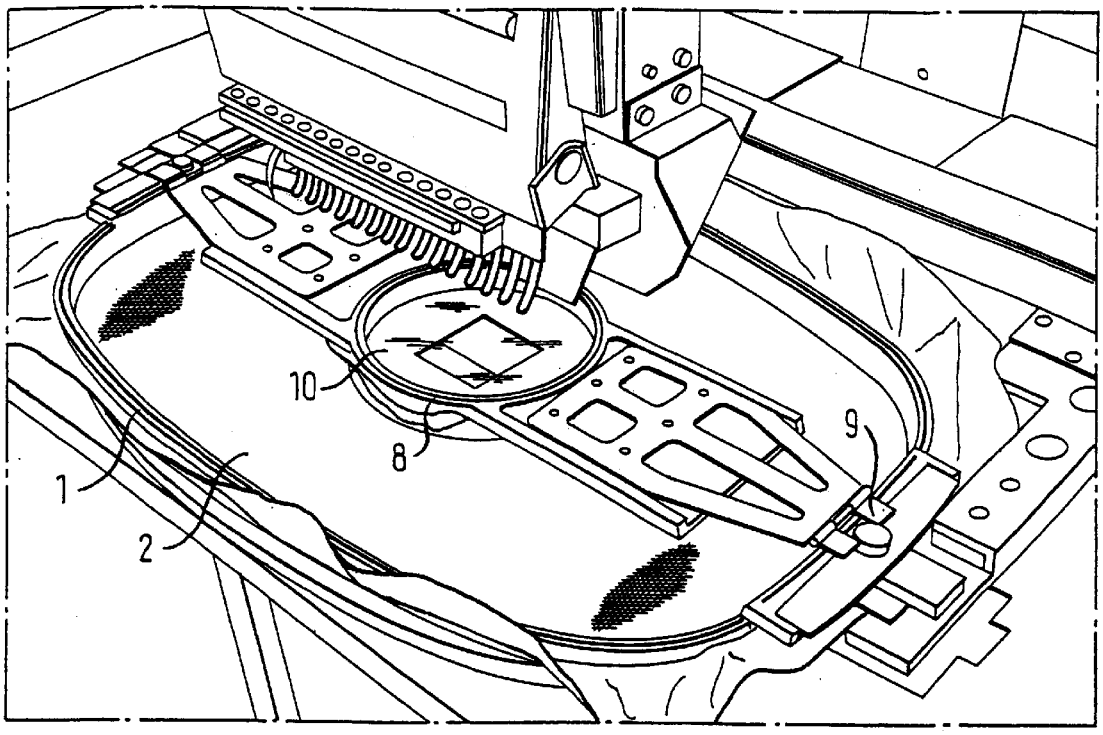
FIG. 5 is a perspective illustration of the embroidering machine, with an auxiliary frame fixed in the frame for restraining an auxiliary backing material.
Figure 6:
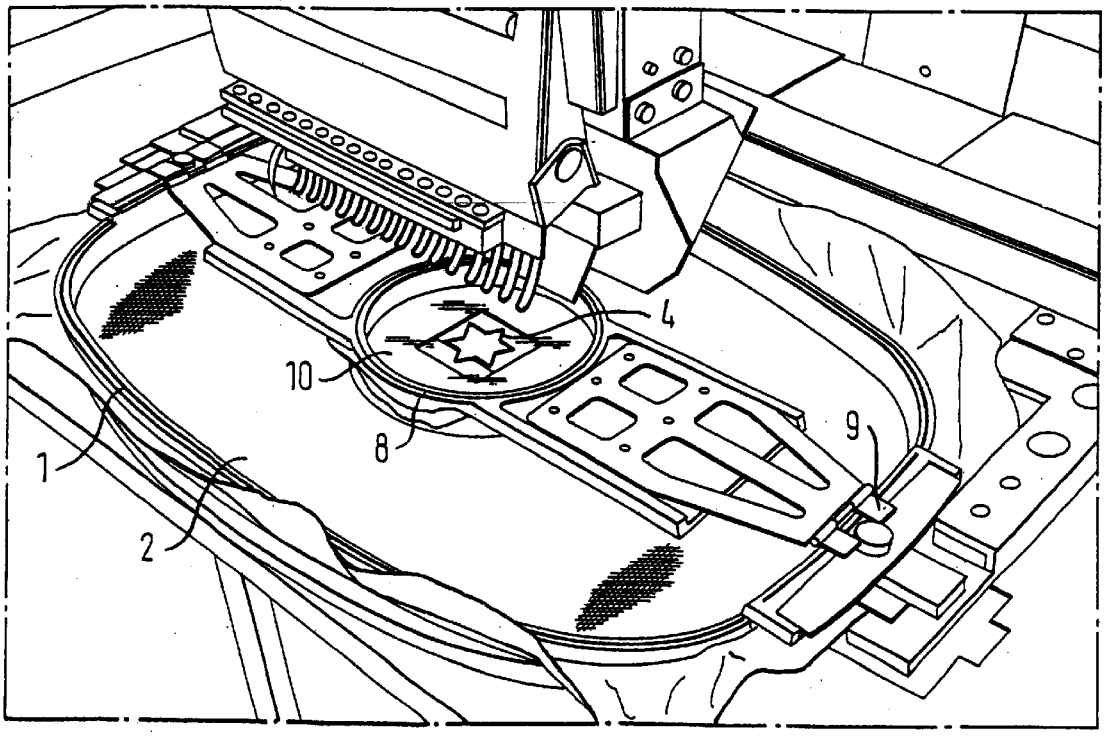
FIG. 6 is a perspective illustration of the embroidering machine, with the motif now embroidered into the auxiliary backing material.
Figure 7:
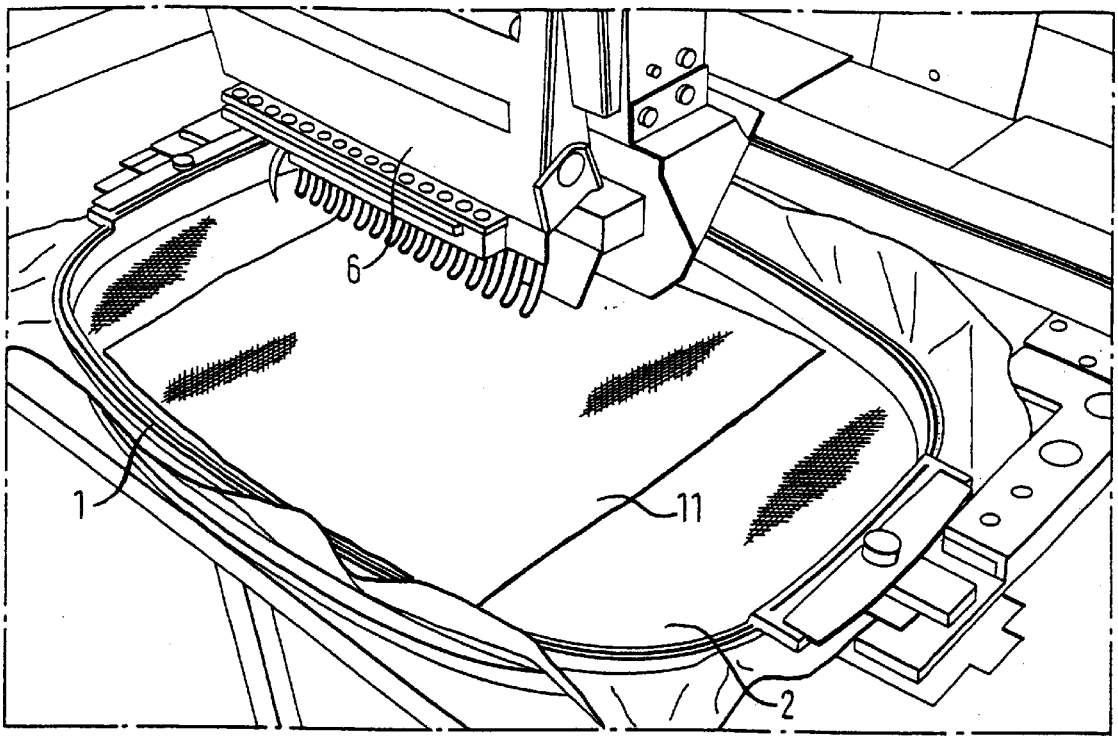
FIG. 7 is a perspective illustration of the embroidering machine, with a base material to be provided with the motif placed onto the backing material.

Referring now to FIG. 4, there is shown a perspective illustration of the embroidering machine, whereby the frame 1 with the backing material 2 and the cutout 5 is disposed below the embroidering head 6. The embroidering machine is provided with a locking device 7 for securing the frame 1 in place. After placement of the frame 1 with the backing material 2 and the cutout 5, an auxiliary frame 8 is fixed in the frame 1 by means of another locking device 9. An auxiliary backing material 10 is clamped in the auxiliary frame 8, as shown in FIG. 5. The auxiliary backing material 10 may, for example, be a hot-melting film, or a water-soluble film, such as a water-soluble paper. In the next step, as shown in FIG. 6, the motif 4 is embroidered into the auxiliary backing material 10. The auxiliary frame 8 is then removed from the frame 1, and the auxiliary backing material 10 including the already embroidered motif 4 remains clamped into the auxiliary frame 8. A base material 11, e.g. a textile material, to be provided with the motif 4 is then placed onto the backing material 2 and fixed provisionally, e.g. by means of adhesive tapes, in such a way that the region to be provided with the motif 4 is located at the proper are below the embroidering head 6. This step is shown in FIG. 7.

Figure 8:
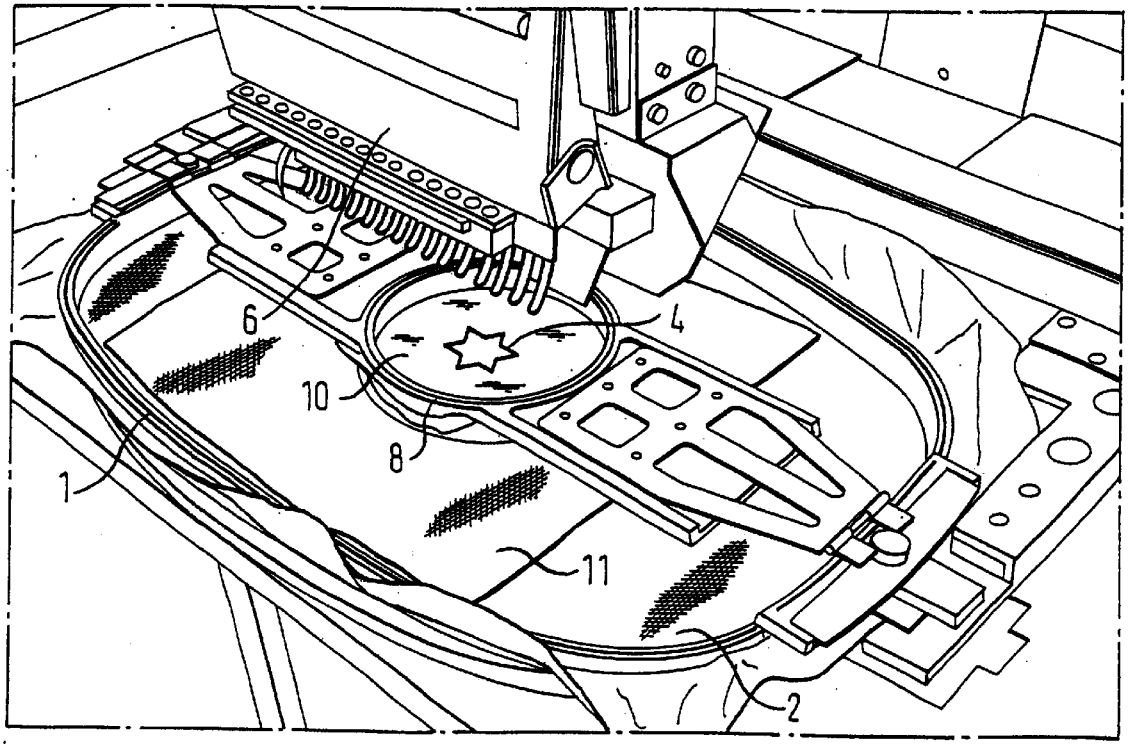
FIG. 8 is a perspective illustration of the embroidering machine, with the embroidering head tacking the motif including the auxiliary backing material onto the base material.
Figure 9:
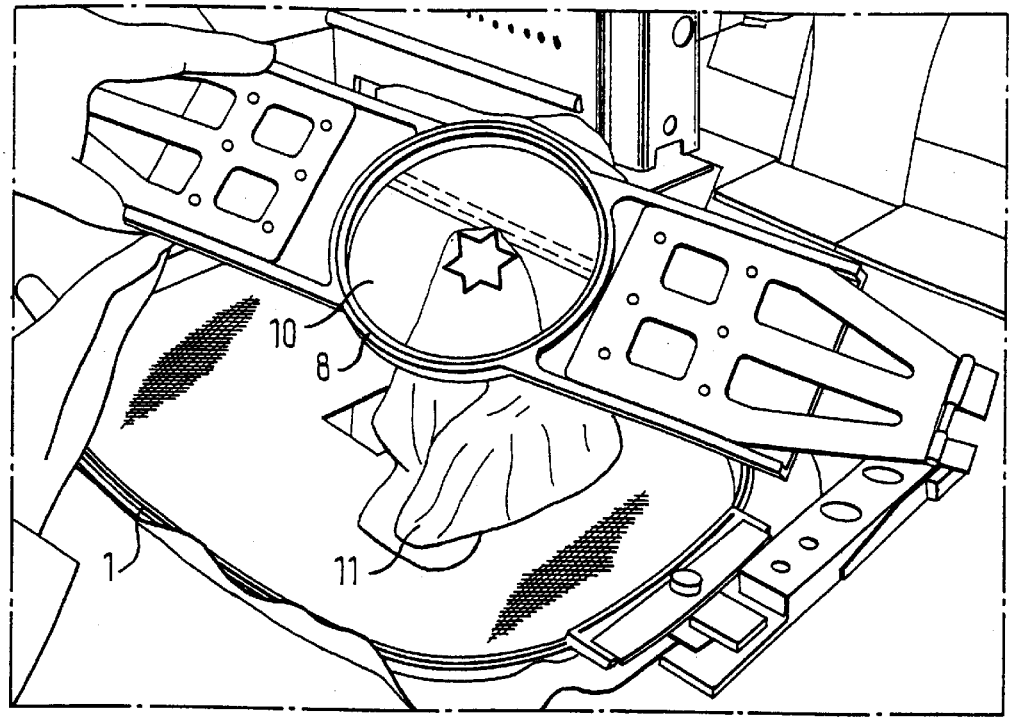
FIG. 9 is a perspective illustration of the embroidering machine, with the finished product being removed from the frame of the embroidering machine.
Figure 10:
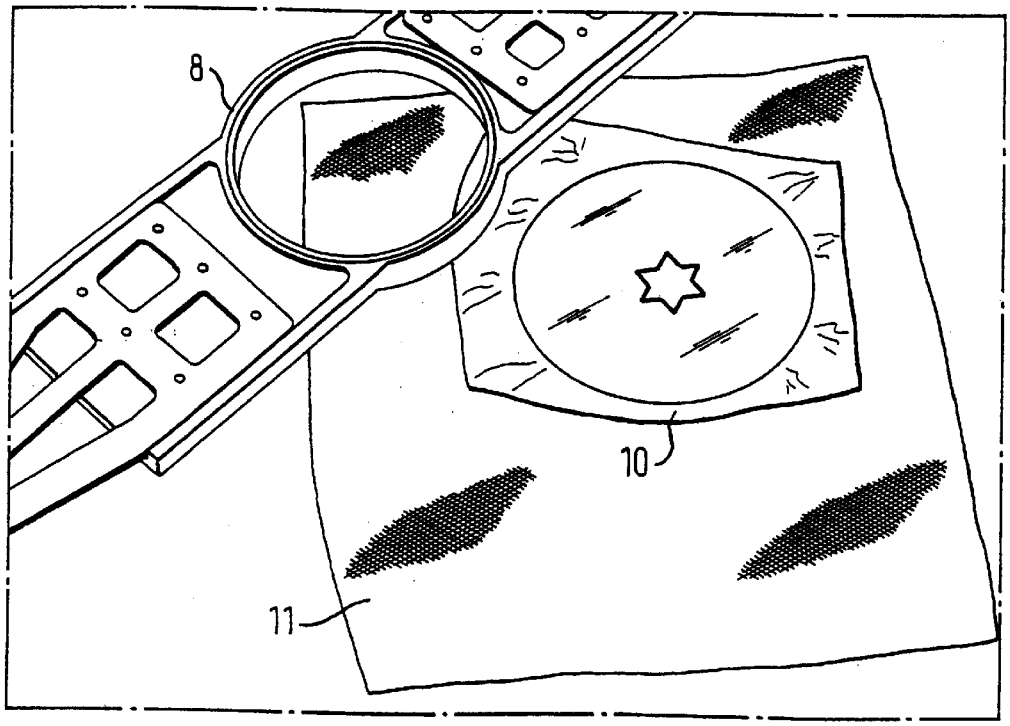
FIG. 10 is a perspective illustration of the unit of auxiliary backing material and base material, detached from the auxiliary frame.

After placement of the base material 11, the auxiliary frame 8 is again fixed in the frame 1, namely in a same position as shown in FIG. 5, whereby the base material 11 is now positioned between the backing material 2 and the auxiliary backing material 10 with the embroidered motif 4, so that the embroidering head 6 can now execute previously programmed embroidering or sewing stitches for tacking the motif 4 including the auxiliary backing material 10 onto the base material 11. This step is shown in FIG. 8. The backing material 2 may be a fabric, which tears more easily than the yarn for the stitches used for the tacking step. Thereafter, as shown in FIG. 9, the base material 11, connected to the auxiliary frame 8 by the embroidering or sewing stitches and by the auxiliary backing material 10, is removed from the frame 1 of the embroidering machine. The unit of auxiliary backing material 10 and base material 11 is then detached from the auxiliary frame 8, as shown in FIG. 10.

Figure 11:
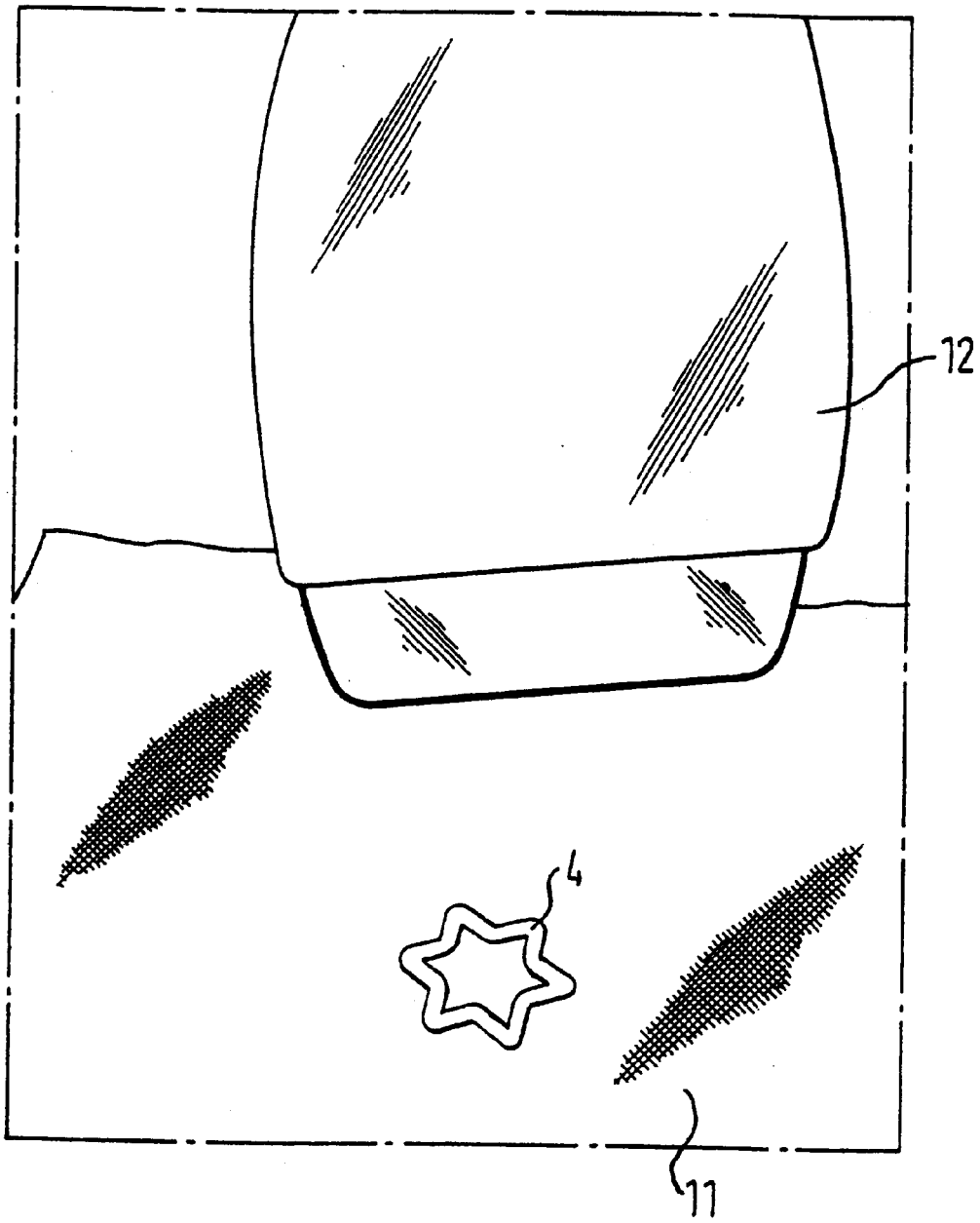
FIG. 11 is an illustration of the finished product upon removal of the auxiliary backing material.

Finally, as shown in FIG. 11, the auxiliary backing material 10 is removed from the base material 11, through application of a flat iron 12 so that the auxiliary backing material 10 melts and adheres to the underside of the iron 12.

The sequence of steps described with reference to the Figures only is exemplary. In particular, it is irrelevant for the work result whether the finished product is removed from the machine together with the auxiliary frame or whether first of all only the auxiliary backing material is unclamped from the auxiliary frame, then the same and only subsequently the finished product is removed from the embroidering machine.

While the invention has been illustrated and described as embodied in an embroidering method, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed is:

1. A method for embroidering a material with a motif by an embroidering machine, comprising the following steps:

a) clamping an auxiliary backing material to an auxiliary frame;

b) fixing the auxiliary frame inside a frame of an embroidering machine;

c) embroidering a motif onto the auxiliary backing material by the embroidering machine;

d) removing the auxiliary frame with the auxiliary backing material from the frame;

e) fixing a material to be provided with the motif in the frame;

f) fixing the auxiliary frame with the auxiliary backing material in the frame in a position above the material;

g) tacking the motif onto the material by embroidering or sewing stitches of the embroidering machine;

h) removing the auxiliary frame;

i) removing the material from the frame; and j) removing the auxiliary backing material.

2. The method of claim 1, and further comprising the step of clamping a backing material into the frame prior to step b).

3. The method of claim 2, wherein the backing material is a fabric which tears more easily than yarn for the stitches used for the tacking step.

4. The method of claim 2, wherein the backing material is provided with a cutout at a location of the motif to be embroidered, wherein the cutout has a size which corresponds at least to a size of the motif.

5. The method of claim 1, wherein the auxiliary backing material is a material which is constructed to enable a removal by physical means.

6. The method of claim 5, wherein the material of the auxiliary backing material includes a plurality of layers.

7. The method of claim 5, wherein the auxiliary backing material is a hot-melting film.

8. The method of claim 5, wherein the auxiliary backing material is a water-soluble film.

9. The method of claim 5, wherein the auxiliary backing material is a water-soluble paper.

10. The method of claim 9, wherein the auxiliary backing material is made of rice paper or cardboard.

* * * * *